US005664701A

United States Patent [19]

Massena

[11] Patent Number: 5,664,701

[45] Date of Patent: Sep. 9, 1997

[54] GLUE GUN SYSTEM WITH REMOVABLE CARTRIDGES

[75] Inventor: Len Massena, Dallas, Tex.

[73] Assignee: Uniplast, Inc., Arlington, Tex.

[21] Appl. No.: 377,842

[22] Filed: Jan. 25, 1995

[51] Int. Cl.[6] ..... B67D 5/62

[52] U.S. Cl. ..... 222/146.5; 219/227; 219/421; 222/190; 222/325; 392/480

[58] Field of Search ..... 222/146.5, 190, 222/325; 219/227, 421; 392/480

[56] References Cited

U.S. PATENT DOCUMENTS

| | | | |
|---|---|---|---|
| 2,556,609 | 6/1951 | Arkless | 154/42 |
| 3,154,811 | 11/1964 | Gardener | 18/13 |
| 3,204,828 | 9/1965 | Paulsen | 222/146 |
| 3,430,816 | 3/1969 | Nadherny et al. | 222/146.5 |
| 3,443,059 | 5/1969 | Spencer | 219/233 |
| 3,459,335 | 8/1969 | Cohen et al. | 222/146 |
| 3,466,752 | 9/1969 | Braun | 32/60 |
| 3,485,417 | 12/1969 | Cocks | 222/146 |
| 3,522,413 | 8/1970 | Chrow | 392/480 X |
| 3,560,703 | 2/1971 | Chedister | 219/222 |
| 3,744,921 | 7/1973 | Weller et al. | 222/146 R |
| 3,896,973 | 7/1975 | Morgan | 222/146.5 |
| 4,103,145 | 7/1978 | Oliveri | 219/222 |
| 4,334,142 | 6/1982 | Blackmore | 392/480 X |
| 4,463,877 | 8/1984 | Siwon | 222/146 HE |
| 4,601,597 | 7/1986 | Bertram et al. | 401/1 |
| 4,639,155 | 1/1987 | Schuster et al. | 401/1 |
| 4,692,587 | 9/1987 | Spirk, Jr. et al. | 219/242 |
| 4,776,490 | 10/1988 | Wingert | 222/146.5 |
| 4,781,482 | 11/1988 | Ursprung | 401/1 |
| 4,926,029 | 5/1990 | Pearson | 222/146.5 X |
| 4,938,388 | 7/1990 | Yeh | 222/146.5 |
| 5,026,187 | 6/1991 | Belanger et al. | 401/1 |
| 5,236,269 | 8/1993 | Handy | 401/1 |
| 5,240,141 | 8/1993 | Blette | 219/227 X |
| 5,324,305 | 6/1994 | Kanner | 606/213 |
| 5,362,164 | 11/1994 | Wingert | 401/2 |
| 5,375,766 | 12/1994 | Sweeney | 239/133 |

FOREIGN PATENT DOCUMENTS

| | | | |
|---|---|---|---|
| 4111248 | 10/1992 | Germany | 222/146.5 |

*Primary Examiner*—Joseph Kaufman

*Attorney, Agent, or Firm*—Gregory M. Howison; Mark W. Handley

[57] ABSTRACT

The glue gun system includes a gun having a barrel. A cartridge can be removably placed in the barrel. The cartridge has an open central passage to accept a glue slick and a tip to dispense the glue. Once received into the barrel the cartridge is heated, melting the glue therein. Additional cartridges can be maintained in a heated state by a heating stand. Thus, after one glue stick is used, a second can be immediately installed and used. An insulated tab allows for the easy handling of the cartridges.

12 Claims, 3 Drawing Sheets

GLUE GUN SYSTEM WITH REMOVABLE CARTRIDGES

TECHNICAL FIELD OF THE INVENTION

The present invention relates to a multi-purpose glue gun system having removable cartridges and a heated stand. Specifically, the system allows the glue gun to accept different sizes and colors of glue stick without spoiling the interior chamber of the gun with remnants of glue from an earlier use. Moreover, the system allows the cartridges to be held in a heating stand so each is ready for immediate use.

BACKGROUND OF THE INVENTION

Glue guns are used in the manufacture of textile products. A glue gun typically accepts a solid glue insert and melts one end of the insert. The melted glue can be controllably discharged from one end of the glue gun through a tip. The glue gun also has a handle to facilitate its handling by an operator. While glue is typically clear, certain textiles are manufactured using colored glues. This poses a problem when switching between different glue sticks. For example, if the user has applied a blue colored glue and then wants to switch to a yellow glue, the residual of blue glue left in the glue gun will initially spoil the color of the yellow glue exiting the tip. One solution to these problem is to have several glue guns, one devoted to each color glue to be dispensed. A second solution involves dispensing the second color of glue onto a waste sheet until the residual first glue has passed. Both solutions are wasteful, expensive and inadequate.

Standard glue guns demonstrate several other problems. For instance, a significant delay occurs after a second glue stick is inserted until it melts. Also, glue guns are typically structured to only accept one diameter of glue stick. Glue sticks can come in various diameters and lengths. Also, the tips of the glue, guns are rarely more than an orifice through which the glue flows. If the user wants to shape the glue or press it into a seam, the tip is invariably fouled. Another problem with existing glue guns relates to the heating units. Once a heating unit burns out the gun is inoperative.

A need exists for a glue gun which can accept variably sized glue sticks including extra long sticks. Such a glue gun should also be able to accept glue sticks of various colors without the risk of residual glue spoiling the next color. Further, a need exists for a glue gun with a tip designed to manipulate the glue after it has been dispensed. Also, a need exists for a glue gun which has an interchangeable healing element. When one heating element burns out, another can be inserted. Last, a need exists for a way of keeping the soon to be used glue sticks in a state virtually ready for use, thus minimizing any down time while the glue stick is heated.

SUMMARY OF THE INVENTION

The present glue gun system is a flexible system capable of handling glue sticks of various colors, diameters and lengths. The glue gun system includes a gun having a barrel. A cartridge can be removably placed in the barrel. The cartridge has an open central passage to accept a glue stick and a tip to dispense the glue. Once received into the barrel the cartridge is heated, melting the glue therein. Additional cartridges can be maintained in a heated state by a heating stand. Thus, after one glue stick cartridge is used, a second can be immediately installed and used. An insulated tab allows for the easy handling of the cartridges. The cartridges can be sized to accept smaller diameter glue sticks. Likewise, a standard cartridge can be downsized with an insertable adapter. An extended length holder can also be attached to the gun to feed an extended length of glue stick. The ability to replace cartridges allows the glue gun to accept glue sticks of various colors without the risk of residual glue spoiling the color of the next glue stick.

The cartridges can have specialized tips designed to manipulate the glue after it has been dispensed. The heating elements can be placed in either the cartridges or the gun itself. In the former case, the cartridges acts as an interchangeable heating element. When the heating element of one cartridge burns out, another cartridge having a functional heating element can be inserted into the barrel of the glue gun.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE DRAWINGS

Figure 1:
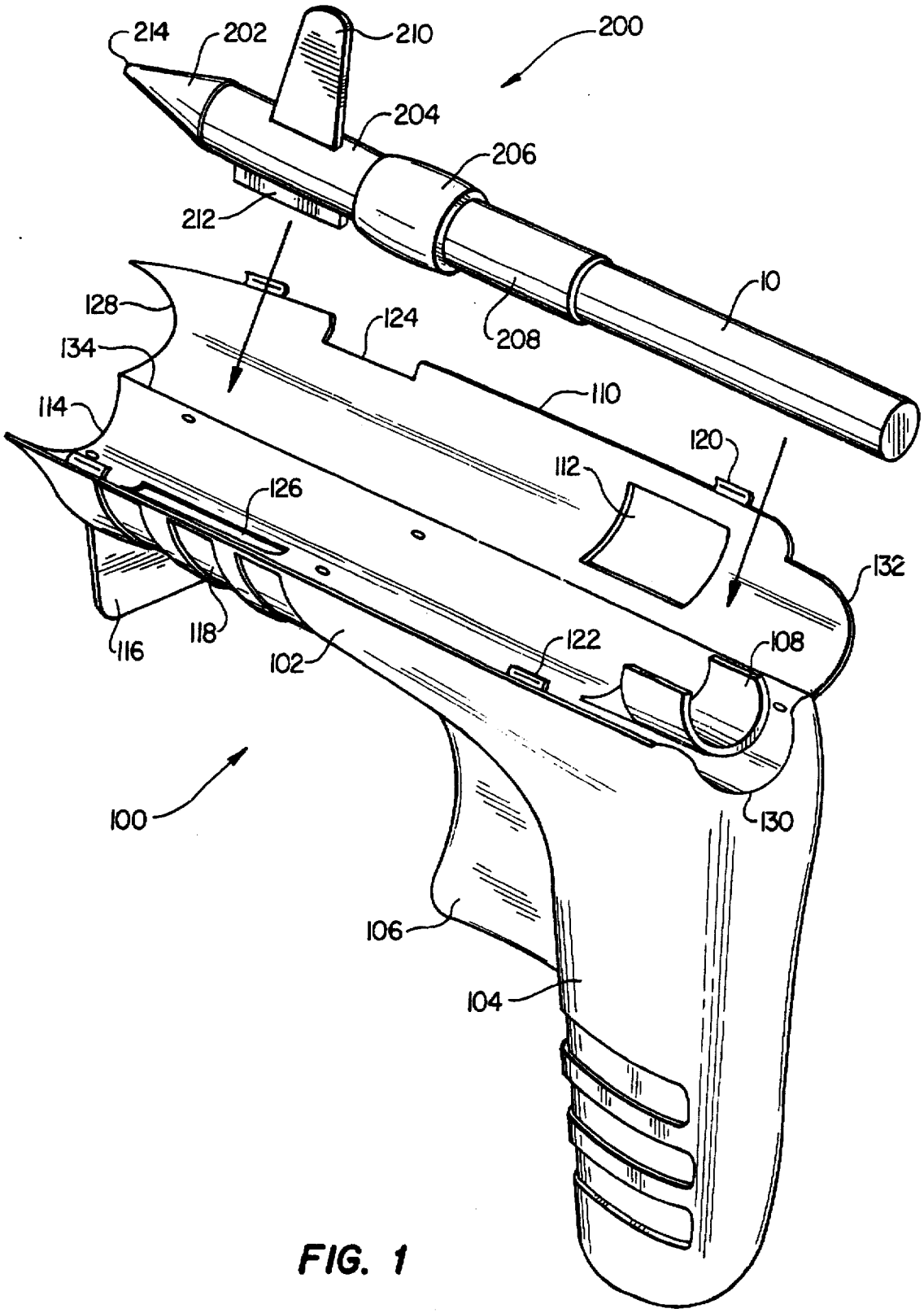
FIG. 1 is a perspective view of a glue gun embodying the present invention accepting a glue stick in a cartridge.

The present glue gun system overcomes many of the disadvantages found in the prior art. Referring to FIG. 1, a glue gun 100 is illustrated which embodies the present invention. The gun 100 has a barrel 102 connected to a handle 104. A trigger 106 is pivotally attached to the handle 104 such that compression of the trigger 106 advances a gripper 108. A stand 116 on the bottom surface of the barrel 102 allows the gun 100 to rest in a stable position. The barrel 102 is generally hollow and accessible by opening an upper lid 110. The lid 110 pivots along hinge 134. Once closed, the lid 110 is secured by placing the clasp 120 over the lip 122. The barrel 102 has a front opening defined by surfaces 114 and 128. Likewise, the barrel 102 has a rear opening defined by surfaces 130 and 132.

A cartridge 200 can be received into the opened barrel 102. The cartridge has a tip 202 with a front orifice 214. The tip 202 of the cartridge 200 extends beyond the surfaces 114 and 128. The cartridge 200 also comprises a generally cylindrical hollow body 204 with an enlarged diameter portion 206. The enlarged diameter portion 206 can closely match the inner diameter of the barrel 102. A conductor 212 attached to the cartridge body 204 is inserted into slot 126 within the barrel 102. The conductor 212 can serve two functions. In one embodiment, a heating element 118 is contained within the barrel 102. Heat is generated by a resistive heating element 118 as is well known in the art. In the first embodiment, heat from the heating element 118 is conducted to the cartridge 200 by conductor 212. In a second embodiment, an electrical connection is provided in the barrel 102 in place of the heating element 118. In the second embodiment, the resistive heating element 118 is contained within the cartridge 200. When the conductor 212 is inserted into the slot 126, current is provided to the cartridge 200 allowing it to heat. In either embodiment, an insulated tab 210 is provided for the user to grasp when withdrawing the cartridge 200 from the barrel 102.

The cartridge 200 also contains a sleeve 208. A glue stick 10 is inserted into the sleeve 208 and advanced into the cartridge body 204 where it is rendered into a viscous fluid state by heating. The stick 10 is advanced into the sleeve 208 by gripper 108 when the trigger 106 is compressed. Advancing the glue stick 10 into the sleeve 208 forces the melted glue in the cartridge body 204 to exit through the tip 202 and orifice 214. The gripper 108 can advance the glue stick 10 to the sleeve 208. Once the end of the glue stick 10 has entered the sleeve 208, another glue stick must be loaded.

If the second glue stick is a different color than the first, a second cartridge can be used. The first cartridge 200 prevented any melted glue from spoiling the inside of the barrel 102. Therefore, a second cartridge containing a second glue stick can be easily inserted into the clean interior of the barrel. The second cartridge will perform in the same fashion as the first. Likewise, the second glue stick will be advanced in the same fashion.

Figure 2:
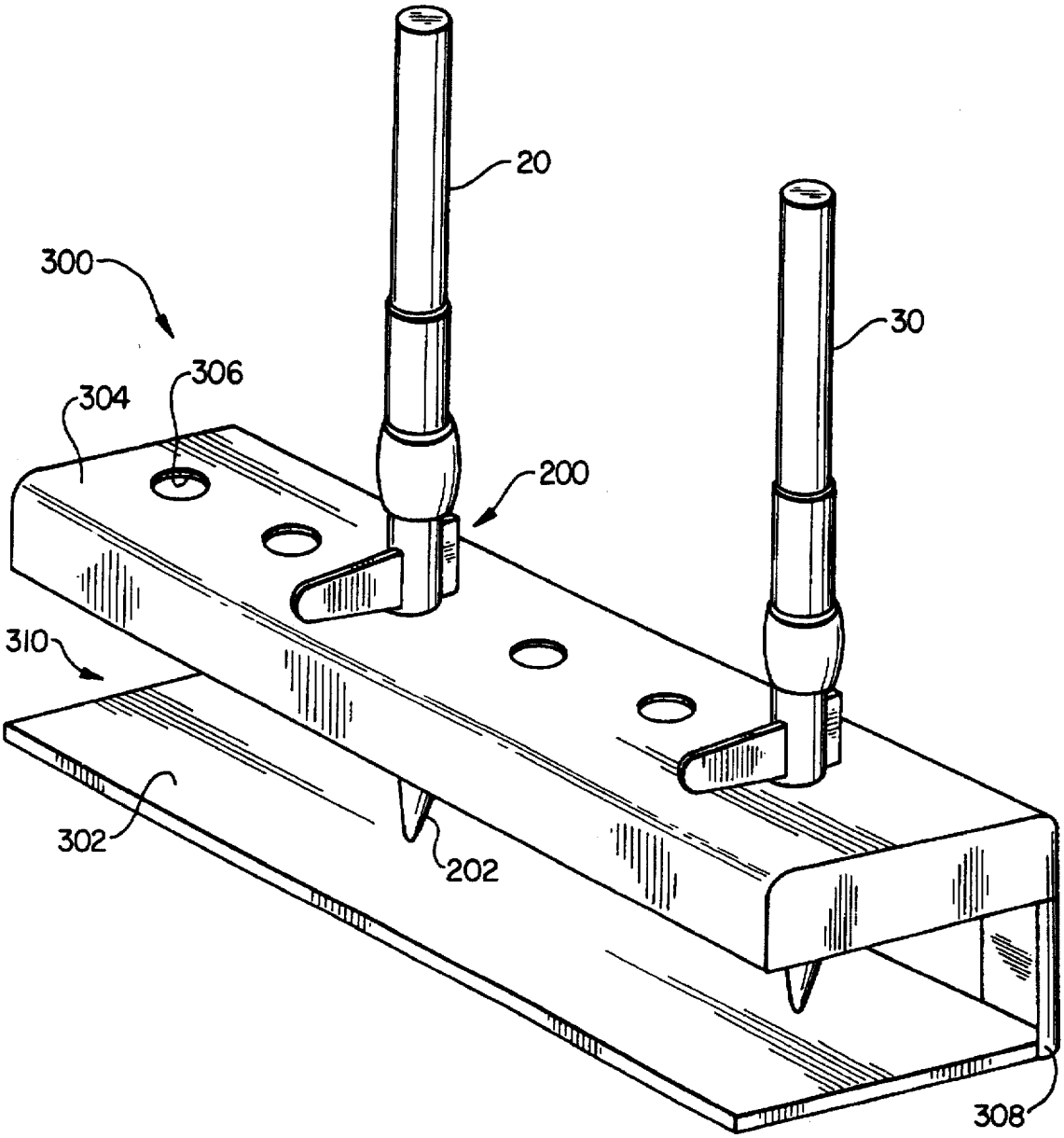
FIG. 2 is a perspective view of a first heating stand to accept unused cartridges, thereby keeping them heated for use.

Additional cartridges with glue sticks 20 and 30 can be kept in a heating stand 300, shown in FIG. 2. The stand has a base 302 and a heating portion 304 connected by posts 308. The heating portion 304 can be spaced from the base 302 by a gap 310. The heating portion 304 has a plurality of openings 306 for accepting the cartridges. Once inserted the cartridges are heated, keeping the glue in the cartridge body 204 in a liquid state. The glue tends not to drip from the lip because the glue stick is not advanced into the cartridge. However, for certain applications, a work piece can be placed in the gap 310. If a glue stick 20 is pushed into the cartridge 200, glue will exit lip onto the work piece. As described earlier, the resistive heating element can be within the heated portion 304 and the heat conducted to the cartridge. Alternatively, a heating element can be placed within the cartridge 200. In this embodiment, current is conducted into the cartridge by the leads within the opening 306. In either case, the cartridge 200 and glue is kept in a heated state to minimize any down time experienced when switching between glue sticks.

Figure 3:
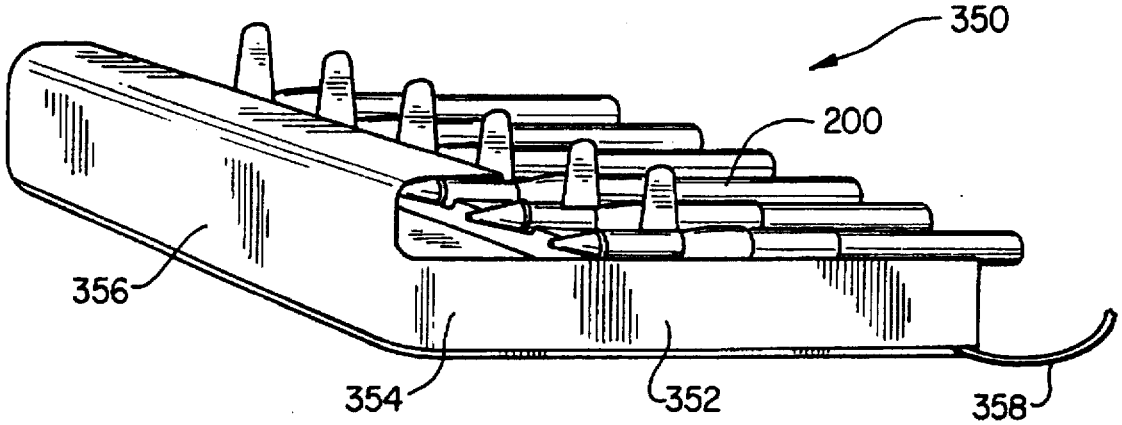
FIG. 3 is a perspective view of a second heating stand.

FIG. 3 illustrates a second style of heating stand 350. The stand 350 has a base 352 which sets on a surface. A tray 354 has a plurality of grooves for accepting cartridges, such as cartridge 200 once set in the grooves, the cartridges are heated by a heating element in the base 352. Alternatively, the heating elements can be placed in the cartridges. In this case, a cartridge engages leads in the grooves which connect the heating element in the cartridge to a source of electricity. In either case, electricity can be supplied to the unit by cord 358. Energy can be supplied by any appropriate source. A heat shield 356 protects the user from the heated cartridges.

Figure 4A:
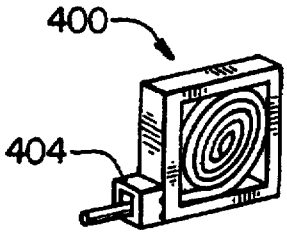
FIG. 4 is an extended length glue stick cartridge which contains a spiral wrapped length of glue and an adapter.
Figure 4B:
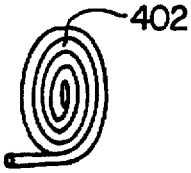
Figure 4C:
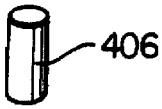

The glue gun system can also accept an extended length glue stick cartridge 400, shown in FIG. 4. Most glue sticks are a relatively short, six to eight inches in length. The cartridge 400 can hold a spiral of solid, yet flexible, glue 402 of lengths around six feet. The glue stick 402 can be provided with a suitable cross section to allow it to more easily be stored in a spiral. A forward tab 404 of the cartridge 400 is accepted between rear surfaces 130 and 132. The glue stick 402 is advanced by grippers 108. The system can also be modified to accept smaller diameter sticks using adapter 406. The adapter 406 can have a reduced diameter central passage for accepting the smaller diameter glue sticks.

Figure 5A:
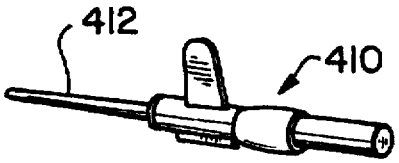
FIG. 5*a* to 5*d* illustrate various cartridges having specialized tips.
Figure 5B:
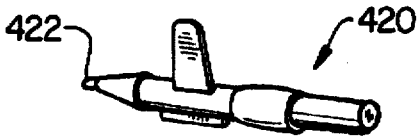
Figure 5C:
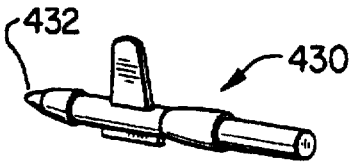
Figure 5D:
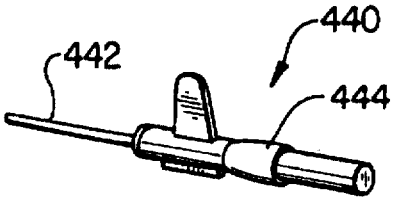

The glue gun system allows for a number of cartridges having specialized tips. FIG. 5*a* illustrates a cartridge 410 having an extended narrow tip 412 which can dispense glue in hard to reach places. FIG. 5*b* illustrates a cartridge 420 having a flattened tip 422, thereby allowing the user to flatten the glue from a thin bead into a flat bed. FIG. 5*c* illustrates a cartridge 430 illustrates a glue gun cartridge 430 suitable for use with a stick of caulk, rather than glue. Caulk sticks perform in the same way as glue sticks, but require a bigger orifice 432 to properly flow. FIG. 5*d* illustrates a specialized cartridge that allows the glue gun system to double as a soldering gun. The soldering tip cartridge 440 has an extended tip 442, but no internal passage to accept a glue stick. The cartridge body 444 simply accepts heat from the healing element and transmits that to the tip 442. With any of the cartridges described above, the heating element can be resident in the cartridge or in the barrel.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

I claim:

1. A glue gun system for dispensing glue from sticks, comprising:

a glue gun having a body with a mating region for accepting a removable cartridge;

said removable cartridge operable to be removably disposed within said mating region and suitable for accepting a glue stick, and having an insulated member disposed about at least a portion of said removable cartridge for a user to grasp when removing said removable cartridge from said mating region in said body of said glue gun while said removable cartridge is at operating temperatures;

said removable cartridge when mated with said body allowing melt flow glue to be dispensed at operating temperatures;

a heating device for heating at least a portion of the glue stick in a cartridge heat zone, said heating device being mounted to said removable cartridge;

a releasable interface for interfacing said removable cartridge with said body to allow said heating device to heat to said operating temperatures when said removable cartridge is mated with said body in said mating region, wherein said interface is interrupted by the action of removing said removable cartridge from a mating relationship with said body; and the glue gun providing a glue-stick gripper and a glue-stick advancement means at a first end of said removable cartridge for moving the glue stick through said cartridge heat zone and dispensing melt flow glue from an opening disposed in a second end of said removable cartridge.

2. The glue gun system of claim 1 wherein said removable cartridge comprises:

(a) a generally cylindrical body having a central passage; and (b) a conductor extending from said cylindrical body.

3. The glue gun system of claim 2 wherein said insulated member comprises:

(c) an insulated tab extending laterally aside of said cylindrical body, transverse to a longitudinal direction of the glue stick and said cylindrical body, such that the user grasps said insulated tab to one side of said cylindrical body when removing said removable cartridge from said body of said glue gun.

4. The glue gun system of claim 2 wherein said conductor conducts electricity from a source in said gun to said heating device which is mounted to said removable cartridge.

5. The glue gun system of claim 1 further comprises:

(d) a heating stand having a plurality of openings, wherein each of said openings is operable for accepting said removable cartridge after removal from said glue gun, and said heating stand having a means for heating said removable cartridge and for heating like removable cartridges.

6. The glue gun system of claim 5 wherein said means for heating comprises a resistive heating element in said stand.

7. The glue gun system of claim 5 wherein said means for heating comprises means to conduct electricity from said stand to a heating element in said cartridge.

8. The glue gun system of claim 1 wherein said removable cartridge comprises:

(c) a tip having an orifice in fluid connection central passage of said removable cartridge; and (d) a extension from said tip.

9. The glue gun system of claim 1 wherein said glue-stick gripper and said glue-stick advancement means include an adapter for different cross-sectional size glue sticks.

10. The glue gun system of claim 1 wherein the glue stick comprises a continuous flexible roll of glue stick.

11. The glue gun system of claim 1 wherein the cartridge heat zone is proximal to said second end of said removable cartridge.

12. A glue gun system for dispensing glue from sticks, comprising:

a glue gun having a barrel body with a central passage for interiorly receiving a removable cartridge;

said removable cartridge operable to be removably disposed within said central passage of said barrel body and having an insulated tab disposed about at least a portion of said removable cartridge for a user to grasp when removing said removable cartridge from said barrel body while said removable cartridge is at operating temperatures;

said removable cartridge suitable for interiorly receiving a glue stick, and having a cartridge heat zone for melting the glue stick therein when said removable cartridge is mated with said body;

said removable cartridge when mated with said body allowing melt flow glue to be dispensed at operating temperatures;

a heating device for heating at least an end portion of the glue stick in said cartridge heat zone, said heating device being mounted to said removable cartridge;

a releasable interface for interfacing said removable cartridge with said barrel body to allow said heating device to heat to said operating temperatures when said removable cartridge is disposed within said barrel body, wherein said interface is interrupted by the action of removing said removable cartridge from said barrel body; and the glue gun providing a glue-stick gripper and a glue-stick advancement means at a first end of said removable cartridge for moving the glue stick through said cartridge heat zone and dispensing melt flow glue from an opening disposed in a second end of said removable cartridge.

* * * * *

UNITED STATES PATENT AND TRADEMARK OFFICE

CERTIFICATE OF CORRECTION

PATENT NO. : 5,664,701
DATED : September 9, 1997
INVENTOR(S) : Len Massena

It is certified that error appears in the above-identified patent and that said Letters Patent is hereby corrected as shown below:

Column 1, line 10, delete "stick", and insert therefor --sticks--;

Column 1, line 38, delete ",";

Column 3, line 31, delete "lip", and insert therefor --tip--;

Column 3, line 35, delete "lip", and insert therefor --tip--;

Column 3, line 47, delete "200 once", and insert therefor --200. Once--.

Signed and Sealed this

Eighth Day of May, 2001

*Attest:*

Nicholas P. Godici

NICHOLAS P. GODICI

*Attesting Officer*

*Acting Director of the United States Patent and Trademark Office*